US009194641B2

(12) United States Patent
Young

(10) Patent No.: US 9,194,641 B2
(45) Date of Patent: Nov. 24, 2015

(54) BARREL ALIGNMENT AND LOCKING ASSEMBLY

(76) Inventor: Nicholas E. Young, Murray, UT (US)

( * ) Notice: Subject to any disclaimer, the term of this patent is extended or adjusted under 35 U.S.C. 154(b) by 127 days.

(21) Appl. No.: 13/246,764

(22) Filed: Sep. 27, 2011

(65) Prior Publication Data

US 2012/0073179 A1 Mar. 29, 2012

Related U.S. Application Data

(60) Provisional application No. 61/387,890, filed on Sep. 29, 2010.

(51) Int. Cl.
*F41A 21/48* (2006.01)

(52) U.S. Cl.
CPC ..... *F41A 21/485* (2013.01)

(58) Field of Classification Search
USPC ..... 42/75.02, 75.01, 76.01, 77, 18, 6; 89/14.05
See application file for complete search history.

(56) References Cited

U.S. PATENT DOCUMENTS

| | | | | | |
|---|---|---|---|---|---|
| 1,015,516 | A * | 1/1912 | Sjögren | 42/18 |
| 1,913,255 | A * | 6/1933 | Von Frommer | 42/18 |
| 2,391,756 | A * | 12/1945 | Vesely | 42/18 |
| 2,585,738 | A * | 2/1952 | Chapin et al. | 42/18 |
| 3,177,603 | A * | 4/1965 | Gillespie | 42/75.02 |
| 4,462,179 | A * | 7/1984 | Rogak et al. | 42/1.07 |
| 4,685,235 | A * | 8/1987 | Bunning et al. | 42/75.02 |
| 4,907,362 | A * | 3/1990 | Hobbie | 42/77 |
| 5,410,834 | A * | 5/1995 | Benton et al. | 42/75.02 |
| 5,765,302 | A * | 6/1998 | Brandl et al. | 42/18 |
| 5,907,919 | A * | 6/1999 | Keeney | 42/75.02 |
| 5,983,773 | A * | 11/1999 | Dionne | 89/29 |
| 6,276,252 | B1 * | 8/2001 | Dionne | 89/29 |
| 6,357,331 | B1 * | 3/2002 | Dionne | 89/29 |
| 6,604,314 | B2 * | 8/2003 | Fluhr | 42/76.01 |
| 6,898,888 | B2 * | 5/2005 | Greenhut | 42/18 |

* cited by examiner

*Primary Examiner* — Reginald Tillman, Jr.

(57) ABSTRACT

An alignment and locking assembly includes an alignment tab having an engagement surface and a feed ramp extending proximally from the engagement surface. The assembly also includes a barrel extension having a distal end, and a proximal end. The proximal end defines a slot configured to matingly receive the engagement surface.

12 Claims, 3 Drawing Sheets

BARREL ALIGNMENT AND LOCKING ASSEMBLY

RELATED APPLICATIONS

This application claims the benefit of U.S. Provisional Application Ser. No. 61/387,890 filed Sep. 29, 2010 and entitled "BARREL ALIGNMENT AND LOCKING ASSEMBLY," the disclosure of which is hereby incorporated by reference in its entirety.

BACKGROUND

Firearms include a receiver, an action, a trigger mechanism, and a barrel. The barrel is often threaded to one end of the receiver. The action translates within the receiver to move cartridges into position within a firing chamber formed in the barrel. Often, a feed ramp is formed in the receiver help guide a tip of the projectile into the chamber. While such a feed ramp may aid in loading cartridges in the chamber, present feed ramps often do not aid in reliable alignment of the barrel and the rest of the firearm.

The subject matter claimed herein is not limited to embodiments that solve any disadvantages or that operate only in environments such as those described above. Rather, this background is only provided to illustrate one exemplary technology area where some embodiments described herein may be practiced.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

As will be discussed in more detail hereinafter, systems and methods are provided for aligning and securing a barrel to a receiver of a firearm. In at least one example, a firearm generally includes a barrel coupled to a receiver by a barrel alignment and locking assembly. The barrel alignment and locking assembly generally includes a barrel extension, a locking lug, and an alignment tab. The alignment tab may be coupled to the receiver in a known position. At the known position relative to the receiver, the alignment tab may serve as a datum for aligning the barrel to the receiver. In particular, the barrel extension may include a slot defined therein. The alignment tab has a feed ramp formed therein. In at least one example, the alignment tab and the slot are configured to couple together to position the feed ramp within the barrel extension. Further, coupling the alignment tab to the barrel extension constrains the barrel extension in a desire position and orientation.

The feed ramp may be secured in a desired position relative to the receiver such that constraining the position of the barrel extension to the feed ramp also constrains the position and orientation of the barrel extension to the feed ramp. Since the barrel extension is secured to the barrel, the barrel is thus placed in a desired position and orientation relative to the receiver as well. With the barrel and barrel extension thus in place, the locking lug may then be rotated to secure the barrel in the desired position. In at least one example, the locking lug engages a corresponding recess defined in the exterior of the barrel extension to thereby secure the barrel recess and the barrel in place relative to the receiver. Such a configuration may allow a barrel to be readily aligned and coupled to a receiver, which in turn may facilitate interchangeability of different barrels with the receiver.

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1:
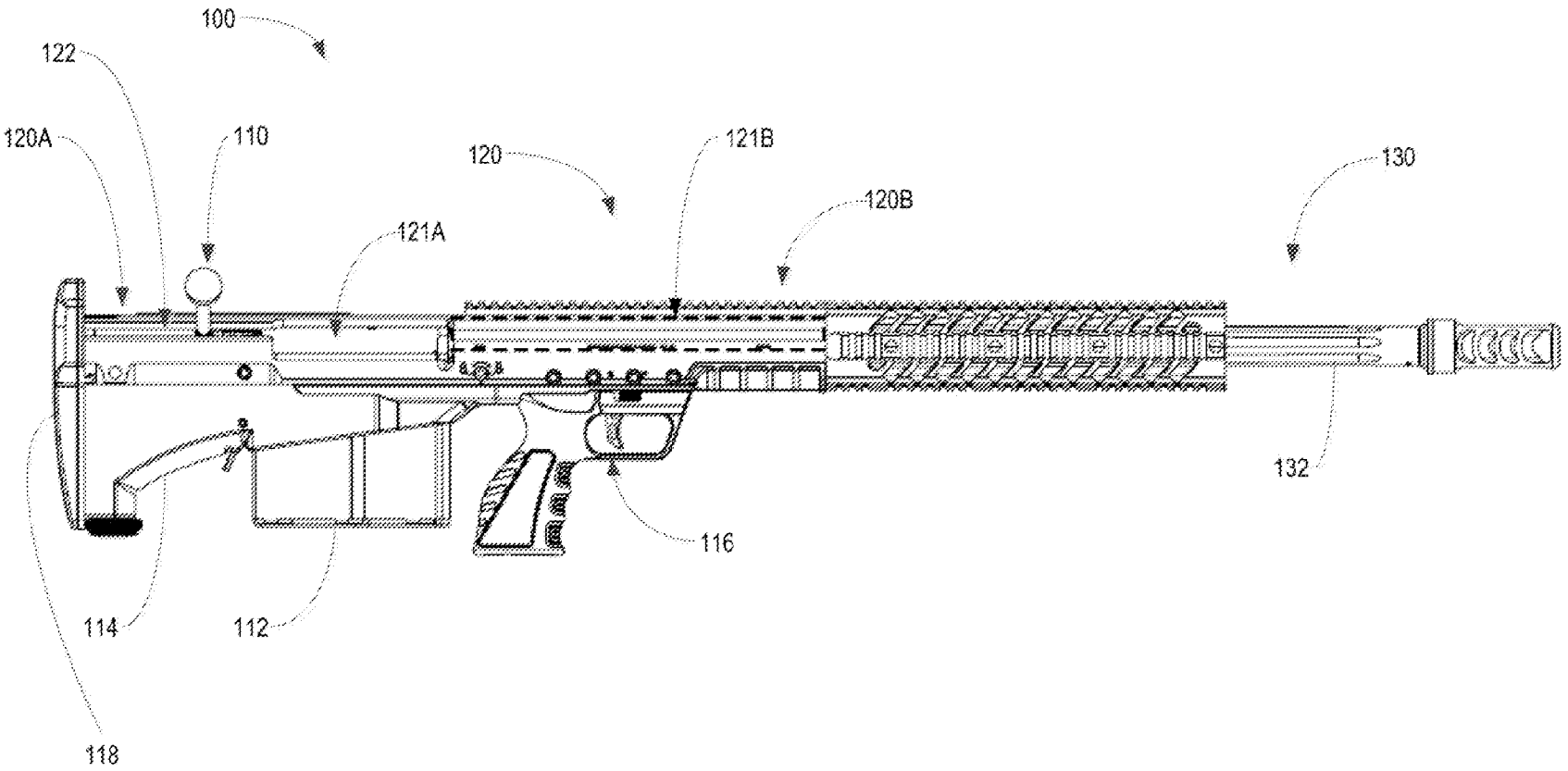
FIG. 1 illustrates a firearm according to one example.

FIG. 1 illustrates a firearm 100 that generally includes an action 110, a magazine 112, stock panels 114, and a trigger assembly 116 that each couple to a receiver 120. A barrel assembly 130 including a barrel 132 is also configured to couple to the receiver 120. A bolt recess 121A is defined in the proximal end 120A of the receiver 120. In at least one example, a handle guide channel 122 is in communication with the bolt recess 121A. The bolt recess 121A and the handle guide channel 122 cooperate to allow the action 110 to cycle relative to the receiver 120 to load and extract cartridges.

The bolt recess 121A may be in communication with a barrel receiving recess 121B extending proximally from the distal end 1208 of the receiver 120 and into communication with the bolt recess 121A. In at least one example, the barrel receiving recess 121B is sized to receive some portion of the barrel assembly 130. An alignment tab 204 (FIG. 2) is configured to align and orient the barrel assembly 130 relative to the receiver 120, as will be discussed at an appropriate point hereinafter.

To assemble the firearm 100, an alignment tab 204 (FIG. 2, described in more detail at an appropriate point hereinafter) is coupled to the receiver 120. The stock panels 114 and the trigger assembly 116 are then coupled to the receiver 120. The barrel assembly 130 is then moved into the receiver 120 and into contact with the alignment tab 204 (FIG. 2) and initially secured in place. The action 110 may then be moved coupled to the receiver 120 by placing the action in the bolt recess 121. Thereafter, the action 110 may be moved into engagement with the barrel assembly 130. The barrel assembly 130 may then be further secured to the receiver 120. A butt pad 118 may then be coupled to the receiver 120 to retain the action 110. The magazine 112 may then be coupled to the receiver 120, thereby completing assembly of the firearm 100.

When the firearm 100 is assembled, the action 110 moves forward to feed a cartridge (not shown) into the barrel assembly 130. In at least one example, the action 110 is configured to feed a cartridge from the magazine 112 into the barrel assembly 130. As the cartridge is fed from the magazine 112, the alignment tab 204 cooperates with the barrel extension 202 to guide the cartridge into position within the barrel 130. In at least one example, the alignment tab 204 is configured to have the magazine 112 placed in sufficient proximity to allow cartridges from the magazine 112 to be guided by the alignment tab 204 into the barrel assembly 130.

As will be discussed in more detail hereinafter, the firearm 100 includes a barrel alignment and locking assembly 200 (FIG. 2) that is configured to aid in the feeding of the cartridge into the barrel 130. Further, the barrel alignment and locking assembly 200 (FIG. 2) is configured to align and position the barrel assembly 130 relative the receiver 120 and to secure the barrel assembly 130 to the receiver at that position and alignment. With the cartridge in position in the barrel assembly 130, the trigger assembly 116 may be actuated to cause the action 110 to fire the cartridge. Thereafter, the action 110 moves rearward to extract the spent cartridge. The configuration of the barrel alignment and locking assembly 200 (FIG. 2) allows the barrel 202 to be readily changed and exchanged as desired while maintaining reliable alignment of the barrel 202 to the receiver 120.

Figure 2:
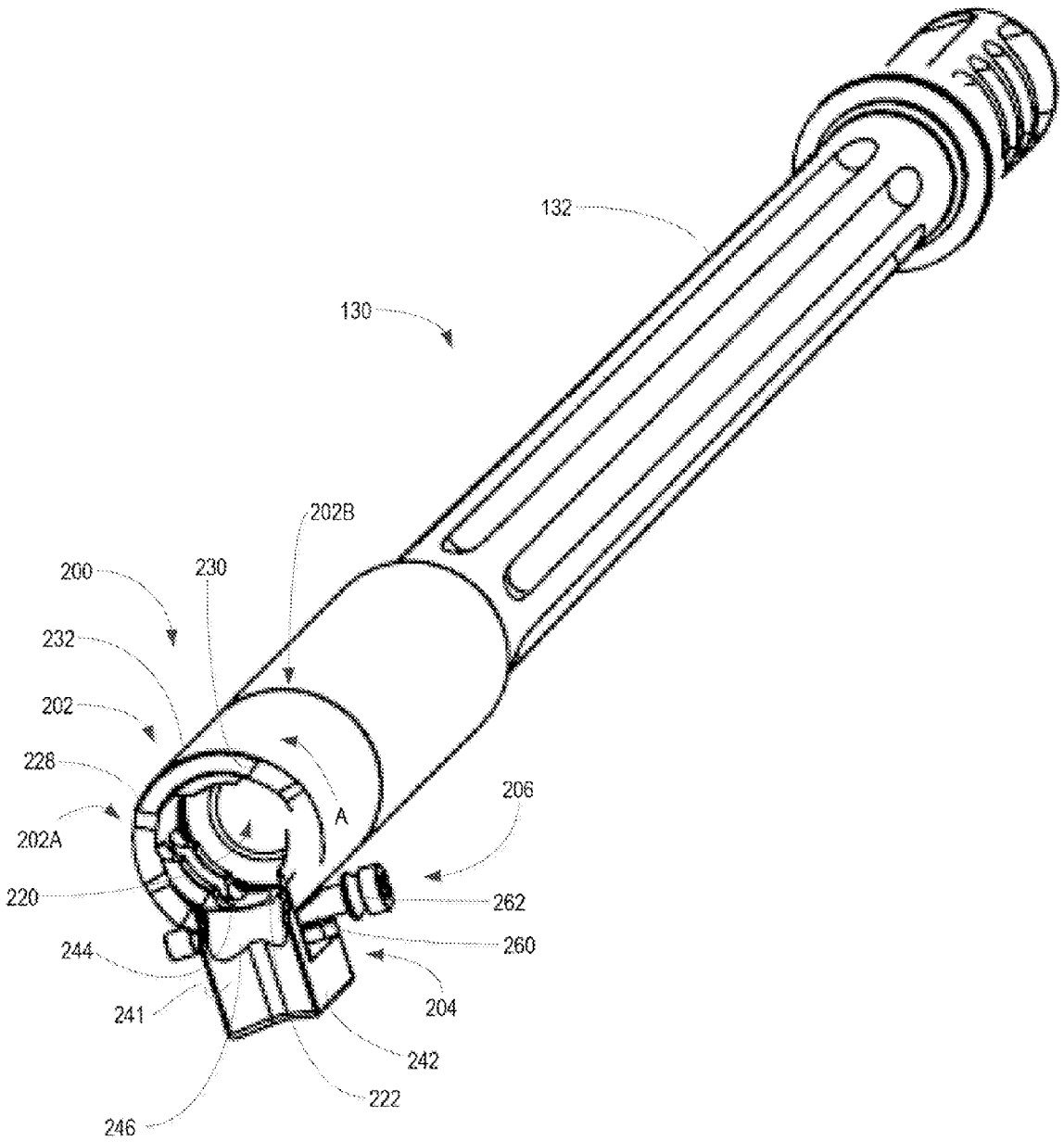
FIG. 2 illustrates an isolated view of a barrel alignment and locking assembly according to one example.

FIG. 2 illustrates an isolated view of a barrel alignment and locking assembly 200. As illustrated in FIG. 2, the barrel alignment and locking assembly 200 includes a barrel extension 202 and an alignment tab 204. The barrel extension 202 is part of the barrel assembly 130 introduced above. The general interaction between the exemplary components of the barrel alignment and locking assembly 200 will first be introduced, followed by a more detailed description of the exemplary components.

In the illustrated example, the barrel extension 202 is configured to be coupled to the barrel 132, though it will be appreciated that in other examples the features described with respect to the barrel extension 202 may be integrally formed with the barrel 132. For ease of reference, the barrel extension 202 may be described as the components located proximally of a chamber formed in the barrel.

Figure 3:
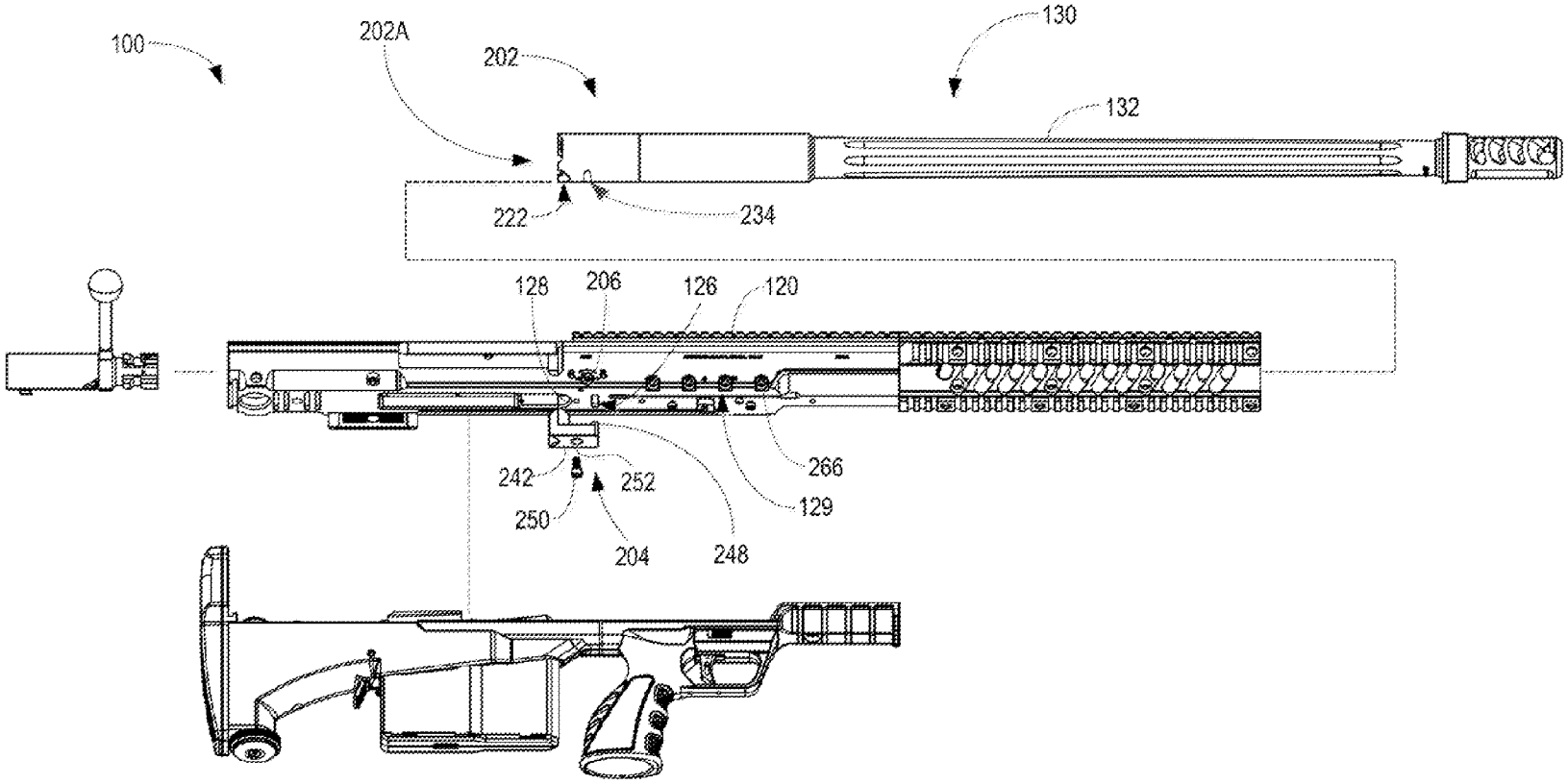
FIG. 3 illustrates an exploded view of a firearm of FIG. 1.

The alignment tab 204 is configured to be coupled to the receiver 120 (FIG. 3), which coupling will be described in more detail at an appropriate point hereinafter. When coupled to the receiver 120 (FIG. 3), the alignment tab 204 is located at a known position and orientation relative to the receiver 120 (FIG. 3). For ease of reference, the alignment tab 204 will be described as being at a relatively fixed, known position with respect to the receiver 120 (FIG. 3).

As shown in FIG. 2, the barrel extension 202 and the barrel 120 may be moved into engagement with the alignment tab 204. As described above and shown in FIGS. 1 and 2, the receiver 120 defines the barrel receiving recess 121B configured to receive a portion of the barrel assembly 130, such as the barrel extension 202. The barrel extension 202 may be moved into position relative to the receiver 120 by placing the barrel extension 202 in the barrel receiving recess 121B and moving the barrel extension 202 proximally until the barrel extension 202 contacts the alignment tab 204. The barrel extension 202 may then be rotated until the barrel extension 202 is properly aligned and positioned against the alignment tab 204.

While thus mated to the alignment tab 204, the barrel assembly 130 is positioned and aligned with respect to the receiver 120. In particular, the barrel extension 202 includes a proximal end 202A and a distal end 202B. The distal end 202B of the barrel extension 202 couples to the barrel 132. The barrel extension 202 includes a bore 220 defined therein that passes through the proximal end 202A and the distal end 202B of the barrel extension 202. A slot 222 (best seen in FIG. 3) is defined in the barrel extension 202 adjacent the proximal end 202A thereof and extends distally from the proximal end 202A. The slot 222 is configured to mate with corresponding features of the alignment tab 204.

As illustrated in FIG. 2, the alignment tab 204 includes a first portion 241 and a second portion 242 oriented transversely from and extending distally from the first portion 241. In the illustrated example, the second portion 242 extends distally from the first portion 241, though it will be appreciated that the second portion 242 may extend any desired direction from the first portion 241. The first portion 241 may be configured to allow the magazine 112 (FIG. 1) to abut the alignment tab 204. Accordingly, in at least one example the first portion 204 may have a shape corresponding to a distal portion of the magazine 112.

The first portion 241 includes an engagement surface 244. The engagement surface 244 is shaped to allow the first portion 241 to abut against the slot 222 of the barrel extension 202. When the alignment tab 204 abuts the barrel extension 202, the engagement surface 244 abuts the slot 222. In the illustrated example, the engagement surface 244 has rounded corners. As a result, the slot 222 has correspondingly rounded features to allow the engagement surface 244 to mate closely with the slot 222.

As illustrated in FIG. 2, the first portion 241 further includes a feed ramp 246 extending proximally from the engagement surface 244. When the engagement surface 244 abuts the slot 222, a portion of the feed ramp 246 acts to guide cartridges into the barrel 132. The portion of the feed ramp that contacts cartridges may be described as a guide portion of the feed ramp 246. In at least one example, 25 percent or more of the guide portion of the feed ramp 246 may be received within the slot 222. In some examples, more than half of the guide portion is received within the slot 222. In still other examples, more than 75 percent of the guide portion of the feed ramp 246 is received within the slot 222. In still other examples, more than 90 percent of the guide portion is received within the slot 222. It will be appreciated that additional inclined surfaces may be provided which are not part of the guide portion of the feed ramp and thus may be omitted in calculating the ranges described above. For example, in an example where an inclined surface with a unit length of one is utilized but in which only one half of the inclined surfaces acts as a guide portion, the range contemplated would be greater than 25 percent of the one-half unit length that acts as a guide portion. In at least one example, the feed ramp 246 may be oriented at angles between about 30 degrees about 50 degrees as measured relative to an axis parallel to the axis defined by the bore of the barrel extension 202.

In the illustrated example, lugs 226 are formed on the interior of the bore 220 of the barrel extension 202. The lugs 226 may interact with the action 110 (FIG. 1) to help lock the action 110 (FIG. 1) into place with the barrel extension 202 as is known in the art.

As introduced, the alignment tab 204 is configured to be located at a known position and orientation relative to the receiver 120. As shown in FIG. 3, the alignment tab 204 includes a locating extension 248 that extends away from the second portion 242 of the alignment tab 204. A locating slot 126 is defined in the receiver 120 and is configured to receive the alignment tab 204 at least partially therein. When the locating extension 248 is received within the locating slot 126, the position and orientation of the alignment tab 204 relative to the receiver 120 is known.

In at least one example, the alignment tab 204 may be secured at the known position and orientation 120 by use of a fastener 250. In particular, a fastener hole 252 may be defined in the second portion 242 of the alignment tab 204 that is aligned with a corresponding fastener hole 128 defined in the receiver 120. With the fastener holes 128, 252 thus aligned, the fastener 250 may be used to secure the alignment tab 204 to the receiver 120. Though the alignment tab 204 is described separately from the receiver 120, it will be appreciated that the alignment tab 204 may be integrated with the receiver 120 in some examples.

The use of the separate alignment tab 204 may facilitate the use of different materials for the receiver 120 and the alignment tab 204. For example, a relatively lightweight and/or easily machined material may be used in the manufacture of the receiver 120 while a more durable material may be used for the alignment tab 204. Such a configuration may limit wear of the receiver 120 that would otherwise be associated with locating the barrel extension 202 relative to the receiver 120.

Particular, the relatively hard material of the barrel extension 202 contacts the relatively hard material of the alignment tab 204 rather than the relatively soft material of the receiver 120. Lightweight materials may include, without limitation, aluminum alloys, titanium alloys, or combinations thereof. More durable materials may include, without limitation, steel alloys, titanium alloys, and the like.

Accordingly, the barrel assembly 130 may be aligned relative to the receiver 120 by placing the slot 222 in the barrel extension 202 in contact with the engagement surface 244 of the alignment tab 204. In at least one example, the barrel extension 202 includes features for facilitating the placement of the slot 222 into mating engagement with the alignment tab 204.

As shown in FIG. 2, the proximal end 202A of the barrel extension 202 includes a series of ramps 228 and shoulders 230 separated by generally planar guide surfaces 232. When the proximal end 202A of the barrel extension 202 is placed in contact with the alignment tab 204, when the barrel extension 202 is rotated in the direction shown by arrow A, the barrel extension 202 follows the profile of the ramps 228 until the alignment tab 204 moves over the shoulders 230 and down to contact with the guide surfaces 232.

The configuration of the shoulders 230 restricts rotation of the barrel extension 202 in the direction opposite of direction A. Continued rotation in the direction A will eventually cause the alignment tab 204 to move into engagement with the slot 222 as described above, thereby moving the barrel extension 202 and the barrel 130 into an aligned position and orientation relative to the receiver.

The barrel 130 and barrel extension 202 may then be locked in the desired position. As shown in FIG. 2, the barrel alignment and locking assembly 200 may further include a locking bolt 206. The locking bolt 206 is configured to engage a locking channel 234 formed on an outer surface of the barrel extension 202. The locking bolt 206 is configured to be extend into the receiver adjacent the barrel receiving recess 121B (FIG. 1).

As shown in FIG. 2, the locking bolt 206 may include a shaft 260 and a head 262. The shaft 262 may include an eccentric slot cut therein. When the slot is placed adjacent the locking channel 234 (FIG. 3), sufficient clearance is established between the locking bolt 206 and the barrel extension 202 to allow the barrel extension 202 to be withdrawn from the receiver 120. When the slot is placed on an opposing side of the locking channel 234 (FIG. 3), the locking bolt 206 locks the barrel extension 202 in place relative to the receiver 120 (FIG. 3). The head 262 may be rotated to move the slot in and out of engagement with the locking channel 234. In the illustrated example, the locking channel 234 is positioned proximally of the locating extension 248 when the barrel extension 202 abuts the alignment tab 204.

As shown in FIG. 3, the firearm 100 is configured to facilitate coupling and removal of the barrel 130 and the barrel extension 202. In particular, a clamp slot 129 may be defined in the receiver parallel to the barrel receiving recess 121B (FIG. 1). When in an untightened position, the clamp slot 129 may be relatively open to thereby provide clearance to allow a portion of the barrel 130 and/or the barrel extension 202 to translate within the receiver 120. As shown in FIG. 3, fasteners 266 may be used to close the clamping slot 129 thereby causing the receiver 120 to tighten against the barrel extension 202 and/or the barrel 130, thereby further securing the barrel extension 202 and the barrel 130 at an aligned position and orientation relative to the receiver 120.

Accordingly, systems and methods have been discussed herein for aligning and securing a barrel to a receiver of a firearm. In at least one example, a firearm generally includes a barrel coupled to a receiver by a barrel alignment and locking assembly. The barrel alignment and locking assembly generally includes a barrel extension, a locking bolt, and an alignment tab. The alignment tab may be coupled to the receiver in a known position. At the known position relative to the receiver, the alignment tab may serve as a datum for aligning the barrel to the receiver. In particular, the barrel extension may include a slot defined therein. The alignment tab has a feed ramp formed therein. Further, coupling the alignment tab to the barrel extension constrains the barrel extension in a desire position and orientation.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An alignment and locking assembly, comprising:

an alignment tab including:

an engagement surface, and a feed ramp extending proximally from the engagement surface; and a barrel extension including:

a distal end, and a proximal end, the proximal end defining a slot configured to matingly receive the engagement surface, wherein the feed ramp further includes a guide portion configured to guide cartridges and wherein at least 25 percent of the guide portion is received within the slot when the engagement surface abuts the slot, the alignment tab is configured to be removably coupled to a receiver of a firearm, the feed ramp is oriented at an angle between 30 degrees and 50 degrees relative to an axis parallel to an axis defined by a bore of the barrel extension, and the proximal end of the barrel extension further includes a plurality of guide surfaces and alternating ramps and shoulders extending proximally from the guide surfaces, the ramps and shoulders configured to allow rotation of the barrel extension in a first direction when the alignment tab abuts the barrel extension and to not allow rotation of the barrel extension in a second direction, the second direction being opposite the first direction.

2. A firearm, comprising:

a receiver defining a barrel receiving recess;

an alignment tab coupled to the receiver, the alignment tab including an engagement surface, and a partial feed ramp extending proximally from the engagement surface; and a barrel extension including a distal end and a proximal end, the proximal end defining a slot configured to matingly receive the engagement surface when the barrel extension is positioned in the barrel receiving recess to align and orient the barrel extension relative to the receiver.

3. The firearm of claim 2, further comprising a locking bolt coupled to the receiver, the locking bolt including a shaft having an eccentric slot defined therein and wherein a locking channel is defined in an outer portion of the barrel extension, the locking channel being transverse to an axis defined by a bore of the barrel extension.

4. The firearm of claim 3, wherein a clamping slot is defined in the receiver, wherein varying a size of the clamping slot varies a size of the barrel receiving recess to selectively secure the barrel extension and release the barrel extension from the receiver.

5. The firearm of claim 2, wherein the feed ramp further includes a guide portion configured to guide cartridges and wherein at least 25 percent of the guide portion of the feed ramp is received within the slot when the engagement surface abuts the slot.

6. The firearm of claim 5, wherein the alignment tab is configured to be removably coupled to the firearm.

7. The firearm of claim 6, wherein the alignment tab includes a first portion and a second portion, the first portion including the partial feed ramp and the engagement surface and wherein the second portion further includes a locating extension configured to couple the alignment tab to the receiver.

8. The firearm of claim 2, wherein the proximal end of the barrel extension further includes a plurality of guide surfaces and alternating ramps and shoulders extending proximally from the guide surfaces, the ramps and shoulders configured to allow rotation of the barrel extension in a first direction when the alignment tab abuts the barrel extension and to not allow rotation of the barrel extension in a second direction, the second direction being opposite the first direction.

9. The firearm of claim 2, wherein the engagement surfaces has rounded corners.

10. The firearm of claim 2, further comprising a plurality of barrel extensions associated with the firearm and wherein the barrel extensions are configured to be interchangeably coupled the receiver and to be aligned and oriented relative to the receiver by way of engagement with the alignment tab.

11. A firearm, comprising:

a receiver formed a first material, the receiver defining a barrel receiving recess;

an alignment tab formed from a second material, the second material being harder than the first material, wherein the alignment tab includes an engagement surface, and a feed ramp extending proximally from the engagement surface; and a barrel extension including a distal end and a proximal end, the proximal end defining a slot configured to receive the engagement surface, wherein the alignment tab is coupled to the receiver and is further configured to align the barrel extension to the receiver when the slot abuts the engagement surface.

12. The firearm of claim 11, further comprising a plurality of barrel extensions associated with the firearm and wherein the barrel extensions are configured to be interchangeably coupled the receiver and to be aligned and oriented relative to the receiver by way of engagement with the alignment tab.

* * * * *